US006872099B2

(12) United States Patent
Cret

(10) Patent No.: US 6,872,099 B2
(45) Date of Patent: Mar. 29, 2005

(54) STAMPED BATTERY TERMINAL EXHIBITING A PIVOTING CLAMPING MECHANISM

(75) Inventor: Gavril Cret, Sterling Heights, MI (US)

(73) Assignee: Alcoa Fujikura Limited, Franklin, TN (US)

( * ) Notice: Subject to any disclaimer, the term of this patent is extended or adjusted under 35 U.S.C. 154(b) by 14 days.

(21) Appl. No.: 10/368,497

(22) Filed: Feb. 18, 2003

(65) Prior Publication Data

US 2004/0161980 A1 Aug. 19, 2004

(51) Int. Cl.[7] ..... H01R 9/26
(52) U.S. Cl. ..... 439/716
(58) Field of Search ..... 439/716, 762, 439/773

(56) References Cited

U.S. PATENT DOCUMENTS

| | | | | | |
|---|---|---|---|---|---|
| 1,724,753 | A | * | 8/1929 | White | 439/761 |
| 3,568,139 | A | * | 3/1971 | Delzer | 439/759 |
| 3,764,961 | A | | 10/1973 | Poitras | 339/238 |
| 4,385,796 | A | | 5/1983 | Eriksson | 339/238 |
| 4,555,159 | A | | 11/1985 | Chartrain et al. | 339/239 |
| 4,758,188 | A | | 7/1988 | Yates | 439/759 |
| 5,254,020 | A | | 10/1993 | Obligar | 439/761 |
| 5,316,505 | A | * | 5/1994 | Kipp | 439/762 |
| 5,389,466 | A | | 2/1995 | Inoue et al. | 429/178 |
| 5,575,693 | A | | 11/1996 | Dykas et al. | 439/773 |
| 5,595,510 | A | | 1/1997 | Obligar | 439/761 |
| 5,879,202 | A | | 3/1999 | Zhao | 439/762 |
| 5,893,781 | A | | 4/1999 | Matsunaga et al. | 439/762 |
| 6,152,785 | A | | 11/2000 | Haller et al. | 439/766 |
| 6,238,253 | B1 | | 5/2001 | Qualls | 439/759 |
| 6,287,155 | B1 | | 9/2001 | Yakovich | 439/772 |
| 6,459,233 | B1 | | 10/2002 | Liang | 320/105 |
| 2001/0051469 | A1 | | 12/2001 | Murakami et al. | 439/755 |
| 2002/0022176 | A1 | | 2/2002 | Aw et al. | 429/100 |

* cited by examiner

*Primary Examiner*—Phuong Dinh
(74) *Attorney, Agent, or Firm*—Eckert Seamans Cherin & Mellott, LLC

(57) ABSTRACT

A terminal clamping mechanism for use with a conventional battery having an upwardly extending post. The clamping mechanism includes a compressible battery terminal exhibiting a substantially annular shaped portion generally corresponding to an exterior configuration of the battery post. First and second projecting portions extend in spaced apart manner from opposing ends of the annular shaped portion. A lever arm exhibits an elongate and arcuate shape, a first end of which is secured to a fastener extending through apertures in the spaced apart projecting portions. An intermediate portion of the lever arm abuts against a selected projecting portion and, upon inward actuation of a second arcuate shaped end of the lever arm concurrent with placement of the annular shaped portion about the battery post, the lever arm compressing the terminal in a spring biasing and engaging fashion about the post.

20 Claims, 8 Drawing Sheets

36
96
100
104
108
78
80
82
86
76
112
16
12
40

36
96
100
104
78
12
40
82
80
76

STAMPED BATTERY TERMINAL EXHIBITING A PIVOTING CLAMPING MECHANISM

FIELD OF THE INVENTION

The present invention relates generally to battery terminal post connectors and related clamping mechanisms. More specifically, the present invention discloses an improved clamping mechanism for use with a battery terminal, which does not require the use of any installation tools, and which provides greater ease in attaching/detaching from a conventional battery terminal post.

BACKGROUND OF THE INVENTION

The prior art is well documented with examples of battery post connector/clamping terminal constructions. Among these are included tool-free designs, i.e., those which are capable of being engaged and disengaged from the battery post (terminal) and without the need of any type of installation tool. Examples of such commercially known designs include terminals produced by Socop (France) and Ojop (Sweden). Shortcomings associated with such commercially known battery terminals include faults in their design which render them prone to mechanical failure and/or the tendency of the terminal clamping mechanism to place an undue amount of stress on the associated battery post (this typically being constructed of a soft lead material) and which often results in damage to the post.

Additional examples of battery post connectors drawn from the prior art include U.S. Pat. No. 5,575,693, issued to Dykas et al., and which teaches a flexible loop band and a portion of the band remote from the loop. A flexible arm swingably mounts to the remote portion of the band, and a lever is journalled at one end of the arm. A leg of the lever connects to the loop, and the loop biases the leg away from the post. The electrical connector has a clamping configuration where the one end of the pivot arm is at a position relatively near the flat segment and a post-releasing configuration where the one end of the arm is at a position relatively far from the flat segment. Upon converting to the released configuration, the one end of the arm swings through an intermediate position between its near and far positions and during which the arm is more elastically deformed.

Another example of a battery terminal is set forth in U.S. Pat. No. 5,389,466, issued to Inoue et al., and which teaches a main body and a lever which is pivotal and has a bearing portion cam-shaped and supported on the lever-holding position. The main body further includes an annular electrode engage portion into which the battery post is inserted, first and second tightening plates continuous with an open free end of the electrode-engaging portion, and an electric wire-connecting portion continuous with either of the first or second tightening plates or a circular portion of the electrode-engaging portion. A lever holding portion is continuous with the first tightening plate and projects towards the second tightening plate, thus closing the free end of the electrode-engaging portion and pressing the electrode-engaging portion against the battery post.

Yakovich, U.S. Pat. No. 6,287,155, teaches a battery terminal connector for providing a better and more secure manner of connecting battery cables to batteries. The terminal connector includes a support member having a main portion and a jaw portion integrally attached to the main portion. A further jaw member is pivotally attached to the support member and in opposing relationship to the other jaw portion. Cable fastening members are attached to the support member for clamping the battery terminal connector to a battery cable and a locking assembly is provided for locking the jaw member to the jaw portion of the support member.

Additional examples of a snap-on battery terminal connector, exhibiting a substantially annular post clamp design, is illustrated in U.S. Pat. No. 5,254,020, issued to Obligar, and U.S. Pat. No. 4,385,796, issued to Eriksson. Each exhibits quick connect structure for securing the post clamp to the associated battery post, in the case of Ericksson a toggle joint mechanism, and in the further instance of Obligar a rotatable lever.

SUMMARY OF THE INVENTION

The present invention is a terminal clamping mechanism for use with a conventional battery having an upwardly extending post. As previously discussed, the advantages of the terminal clamping mechanism of the present invention include both its ability to be quickly engaged and disengaged from a conventional and upwardly extending battery post, as well as the ability to engage and disengage the battery post without the need of any installation tooling. Additional advantages include the present design being less sensitive to dimensional variations in the generally conical and tapered shaped construction of the battery posts, as well as the ability to secure the clamping mechanism while applying a lesser degree of force and by virtue of the squeezing force being applied sideways on the extended terminals and as opposed to applied on a side of a formed terminal extrusion.

In a first preferred embodiment, the clamping mechanism includes a compressible battery terminal (usually of copper construction) exhibiting a substantially annular cross sectional shaped and conically extending portion which corresponds generally to that of the conventional battery terminal post. First and second projecting portions extend in spaced apart manner from opposing ends of the annular shaped portion.

A lever arm exhibits a generally elongate and arcuate shape and is secured, in inwardly pivoting fashion and at a first rearward end, to a threaded bolt fastener extending through apertures in the spaced apart projections. An intermediate portion of the lever arm is configured so that it abuts against a selected one of the spaced apart projecting portions. Upon inward actuation of a second arcuate shaped end of the lever arm, and concurrent with placement of the annular shaped portion about the battery post, the lever arm compresses the associated projecting portion in a direction towards the other projecting portion, and consequently compresses and clamps the annular shaped portion of the terminal about the battery post.

Additional features of the lever arm include the provision of an elongated slot extending a projected distance along the first end. The first pivotally connected end of the lever arm terminates in an inwardly directed tab extending through a further aperture defined in the abutting projection portion and such that, upon actuation of the lever arm, the tab releases from the further aperture and the arm is capable of being rearwardly displaced, along the travel direction permitted by the slot, to reseat the tab against the projecting portion in the engaged position.

In a further defined variant, a shoulder is established between a selected annular shaped portion and associated projecting portion. The shoulder is further configured to resistively engage the intermediate portion upon engagement of the lever arm and to thereby provide an additional degree of both clamping engagement of the terminal about the battery post and associated resistive holding force of the lever arm against the terminal. Other and additional features of the first preferred embodiment include provision of a spring-acting wave washer, located on the mounting fastener and in sandwiching fashion between the spaced apart projecting portions, as well as the nut engaged over the threaded projecting end of the fastener bolt.

An electrically insulated cover is also engageable over the battery terminal, upon first engaging the lever arm against the terminal. The cover includes a planar shaped base and at least a forward and downwardly projecting catch portion against which is engaged a forwardly most projecting end of the lever arm. The cover may further provided as a single piece, usually constructed as a soft rubber or PVC material.

Alternatively, the cover may be designed as a hard plastic two piece construction in which a first cover member incorporates the catch portion and is rotatably secured to opposite projecting ends of the fastener. A second cover member eccentrically secures to the first cover member, such as by pins extending inwardly from a forward end and which engage associated configured channels formed in the corresponding rearward end of the first cover member. A forward top portion of the second cover member is secured along a rearward living hinge to facilitate a front edge contact with the rear of the first cover member. In this fashion, the second cover member provides a rearwardly disposed and restraining bias to the first cover member and associated catch portion in the engaged position.

A terminal clamping mechanism according to a second preferred embodiment is also disclosed and again teaches a compressible battery terminal exhibiting a substantially annular shaped portion generally corresponding to an exterior configuration of the battery post. First and second projecting portions also extend in spaced apart manner from opposing ends of the annular shaped portion however, and in the second embodiment, the spaced apart portions project forwardly as opposed to rearwardly of the annular shaped portion.

The lever arm is hingedly engaged to a rearwardly disposed location of the annular shaped portion and, in the second preferred embodiment, exhibits a generally open central portion corresponding in dimension to a cross section of the annular shaped portion. The lever arm further includes a forwardly directed and inwardly tapered portion which, upon downward actuation of the lever arm and concurrent with placement of the annular shaped portion about the battery post, contacts and subsequently compresses the spaced apart projecting portions of the terminal in a spring biasing and engaging fashion about the post.

Additional features of the second preferred embodiment include the tapered portion being resistively engaged to the spaced apart portions. Opposing and inwardly facing surfaces of the tapered portion exhibit a first pair of projections and correspond to outwardly and opposite facing surfaces of the projecting portions which exhibit a second pair of projections. Upon engagement of the lever arm, the first pair of projections resistively interengage with the second pair of projections.

A handle portion projects from a forward-most location of the lever arm and, to facilitate the pivoting engagement of the lever arm to the terminal, a sleeve is integrally defined at the rearward location of the annular shaped portion, whereas a rearward-most location of the lever arm includes a pin resistively seated within the sleeve portion. The lever arm further includes a pair of upwardly extending wing portions at opposite ends of the pin and in order to provide lateral stability to the hingedly connected lever arm.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF PREFERRED EMBODIMENTS

Figure 1:
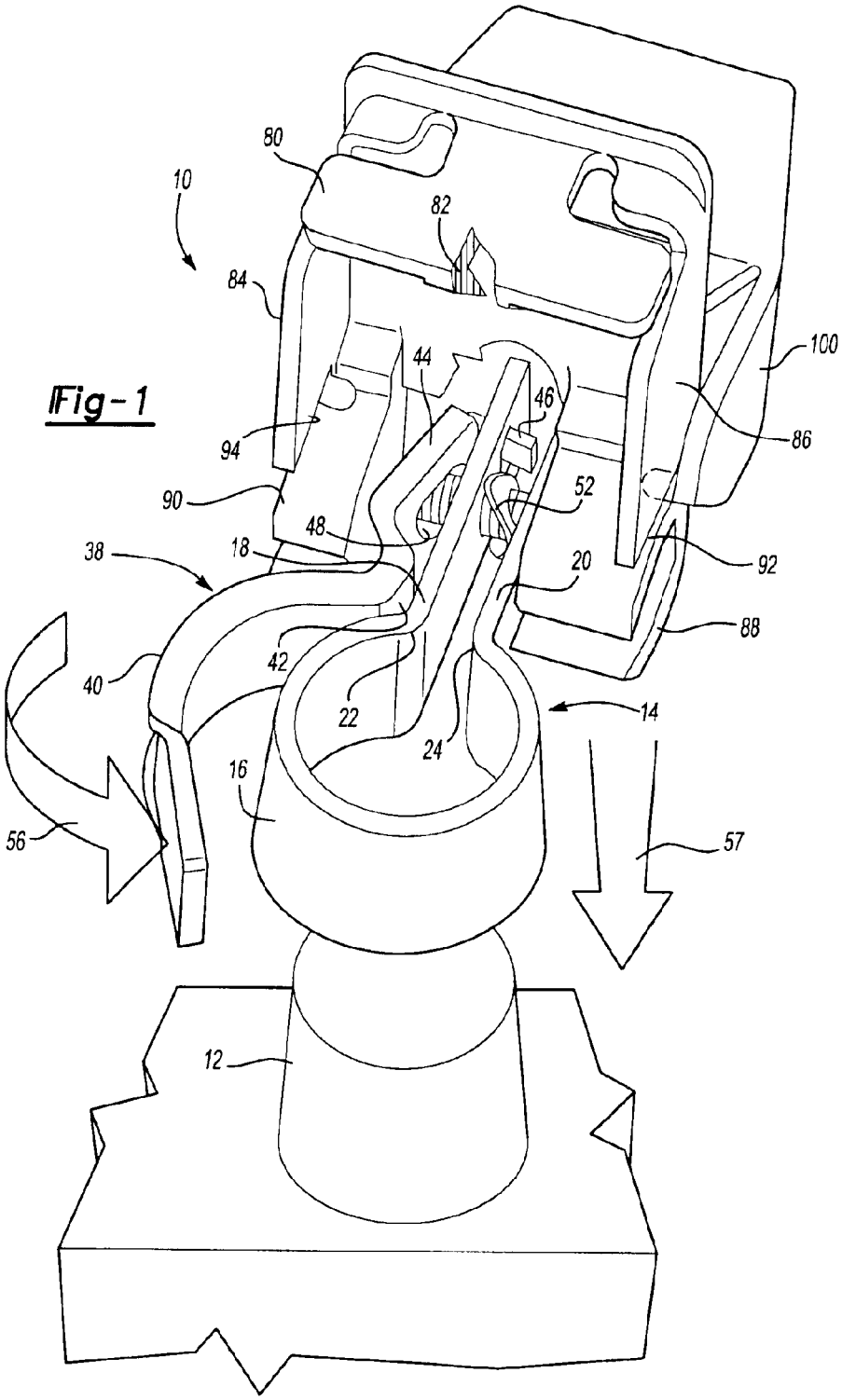
FIG. 1 is a perspective view of the battery terminal in a disengaged position over a conventional battery post and according to a first preferred embodiment of the present invention.

Referring now to FIG. 1, a terminal clamping mechanism is illustrated at 10 according to a first preferred embodiment and for use with a conventional battery having an upwardly extending post 12. As has been again previously discussed, the advantages of the terminal clamping mechanism of the present invention include both its ability to be quickly engaged and disengaged from a conventional and upwardly extending battery post, as well as the ability to engage and disengage the battery post without the need of any installation tooling. Additional advantages include the present design being less sensitive to dimensional variations in the generally conical and tapered shaped construction of the battery posts, as well as the ability to secure the clamping mechanism while applying a lesser degree of force and by virtue of the squeezing force being applied sideways on the extended terminals and as opposed to applied on a side of a formed terminal extrusion.

Figure 2:
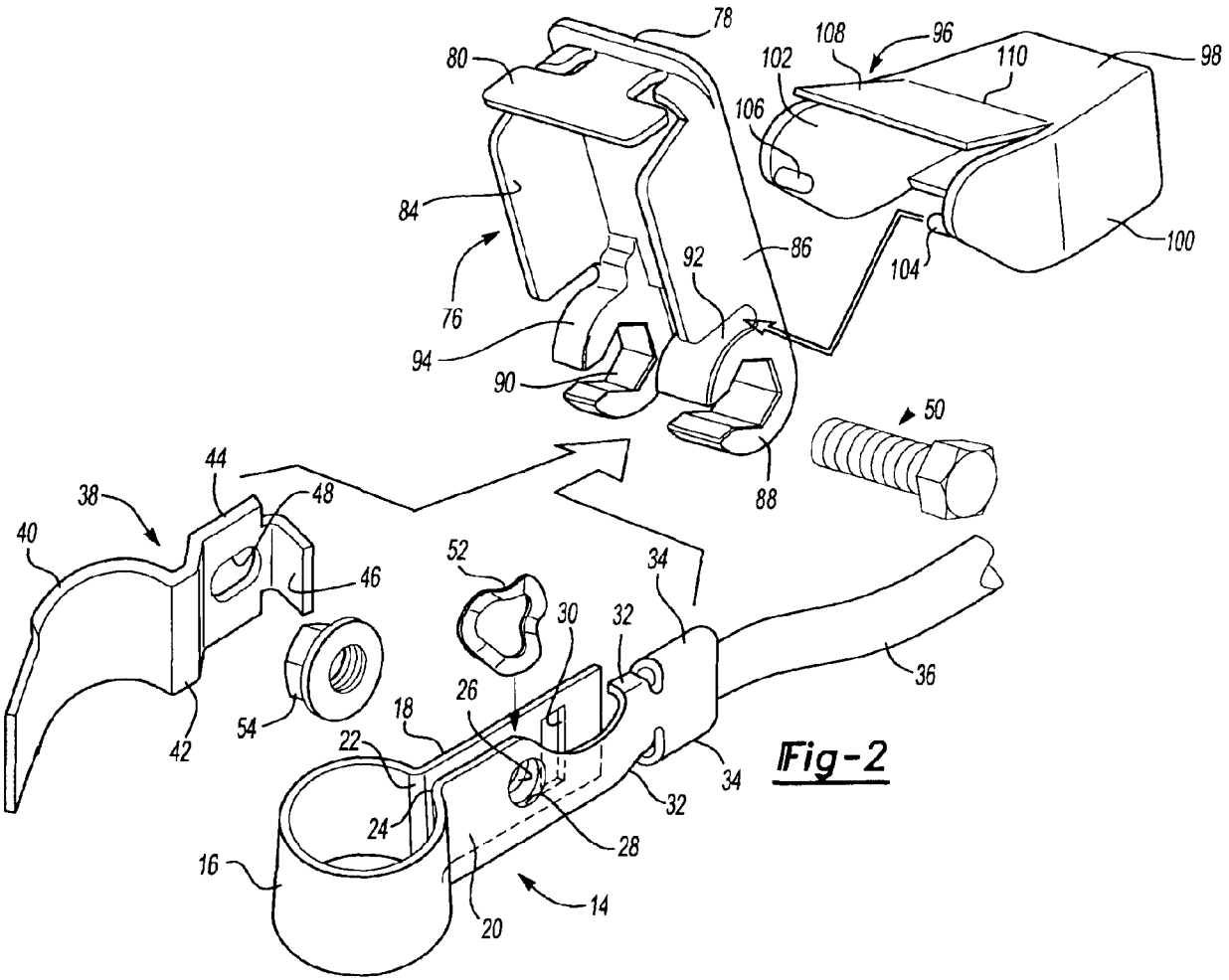
FIG. 2 is an exploded view of the battery terminal design according to FIG. 1.

In the first preferred embodiment, and referencing again the assembled view of FIG. 1 and exploded view of FIG. 2, the clamping mechanism includes a compressible battery terminal 14 (usually of copper construction) exhibiting a substantially annular cross sectional shaped and conically extending portion 16 which corresponds generally to that of the conventional battery terminal post 12. The terminal 14 in a preferred variant is stamped from a 1.5 mm copper (UNS C19400) post tin electro plated material.

First and second projecting portions 18 and 20 extend in a spaced apart, and generally rearwardly, fashion from opposing and generally converging ends 22 and 24 of the annular shaped portion 16. As is best illustrated in the exploded view of FIG. 2, a pair of circular and aligning apertures are defined by annular and inwardly facing side walls 26 and 28 defined through intermediate locations of the first 18 and second 20 projecting portions, respectively. A further rectangular shaped aperture 30 is defined in a further rearwardly spaced location of the first projecting portion 18. As is further best illustrated in FIG. 2, at least one pair of gripping portions, and preferably a first pair 32 and a second pair 34, extend in laterally outward fashion at locations proximate the rearward end of the second projection portion 20. The gripping portions 32 and 34 are configured to grip an exposed end of an electrical cable 36 (see again FIG. 2) and to electrically communicate the given battery post 12 and terminal 14.

A lever arm is generally illustrated at 38 and exhibits a generally elongate and arcuate shape. The lever arm 38, in a preferred variant, is stamped from a 1.5 mm steel material. The lever arm 38, as best again illustrated in exploded fashion in FIG. 2, includes a forward and arcuate shaped portion 40 (corresponding generally to the outer wall configuration of the annular shaped portion 16 of the terminal 14), an intermediate and abutting shaped portion 42, and a rearward and hingedly connecting portion 44 terminating in an inwardly facing tab end 46. A substantially flattened area defined along the rearward portion 44 further is defined by an elongated slot 48 extending therealong and between the intermediate abutting shaped portion 42 and tab 46.

Figure 3:
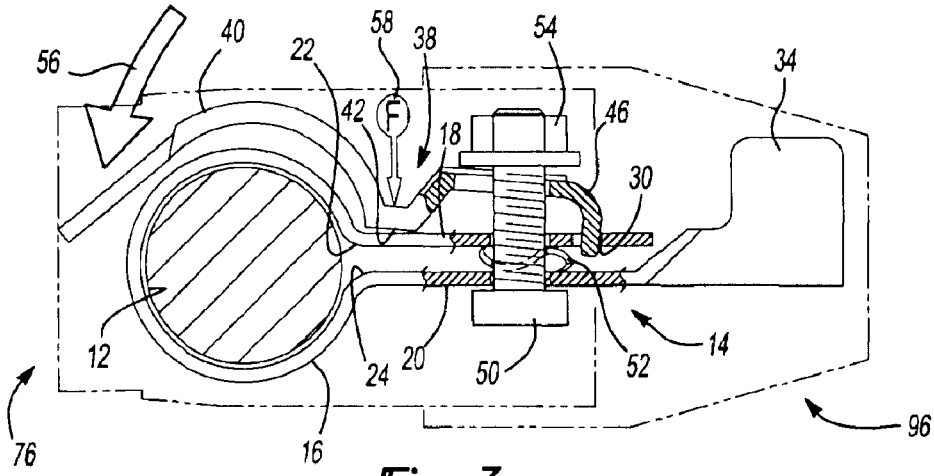
FIG. 3 is a first underside view of the battery terminal, illustrating in phantom the two piece plasticized cover, and in a first substantially disengaged position.
Figure 4:
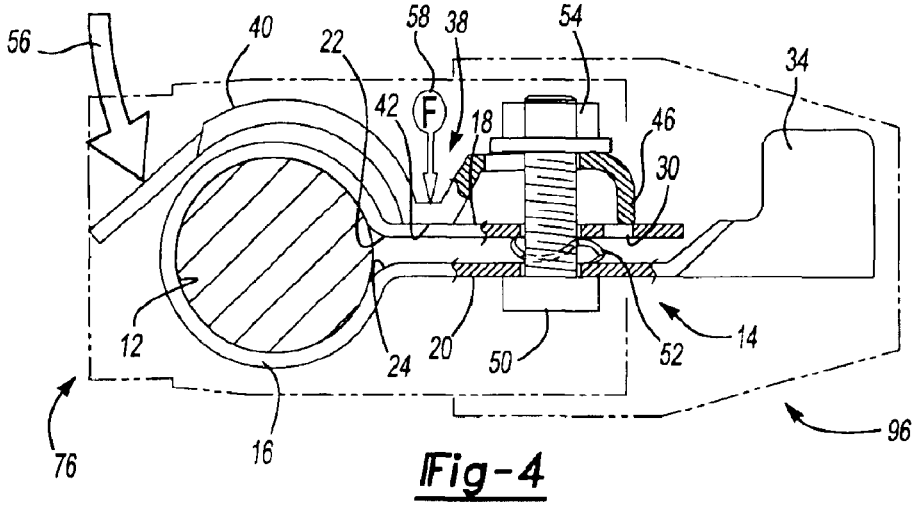
FIG. 4 is a succeeding underside view of the battery terminal in a second and substantially engaged position.
Figure 5:
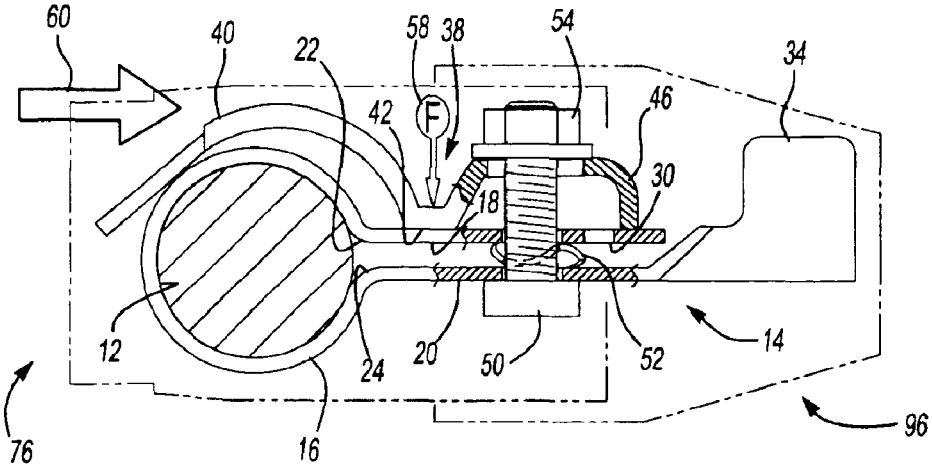
FIG. 5 is a yet succeeding underside view of the battery terminal in a third engaged and locked position and by which the associated lever arm is rearwardly displaced relative to the looped terminal and the threaded mounting bolt.

As illustrated again in FIGS. 1 and 2, as well as the succeeding and progressive engagement views FIGS. 3–5, the lever arm 38 is secured, in inwardly pivoting fashion and at its rearward end 44, to a threaded bolt fastener 50 extending through the aligned apertures 26 and 28 in the spaced apart projections 18 and 20. The outward spring bias of the portions 18 and 20 of the stamped terminal 14 is further assisted by the provision of a spring-acting wave washer 52 located on the threaded shaft portion of the mounting bolt 50 and in sandwiching fashion between the spaced apart projecting portions 18 and 20; a flanged nut 54 engaging over the threaded projecting end of the fastener bolt 50 and in adhering fashion against an outward facing side of the projecting portion 20.

As is again best illustrated in FIGS. 1 and 3–5, the intermediate portion 42 of the lever arm 38 is configured with its inwardly facing and flattened surface so that it abuts against a selected one 18 of the spaced apart projecting portions. Upon inward actuation of the forward and arcuate shaped end 40 of the lever arm 38, see also directional arrows 56 in FIGS. 1 and 3, and concurrent with the location of the annular shaped portion 16 of the terminal 14 about the battery post 12 (see also directional installation arrow 57 in FIG. 1), the lever arm 38 compresses the associated projecting portion 18 in a direction towards the other projecting portion, see further force F indicator 58 in FIG. 3.

The succeeding engaging illustration of FIG. 4 shows the direction of compressive application 56 on the end 40 of the lever arm 38 resulting in the compressing and clamping force 58 causing the intermediate portion 42 to engage the associated flat surface of the portion 18 and to cause the inwardly facing surface of the annular shaped portion 16 of the terminal 14 to be engaged about the corresponding exterior facing configuration of the battery post 12. At this point, and upon actuation of the lever arm, the tab 46 pivotally releases from within the further aperture 30 (from which it was previously seated in the disengaged illustration of FIG. 3) and the arm 38 is capable of being rearwardly displaced, along the travel direction permitted by the slot 48 and as is further referenced by directional arrow 60 in FIG. 5, to reseat the end facing surface of the tab 46 against a solid and rearwardly spaced location of the projecting portion 20 (again FIG. 5) and in the engaged and clamped position.

Figure 10:
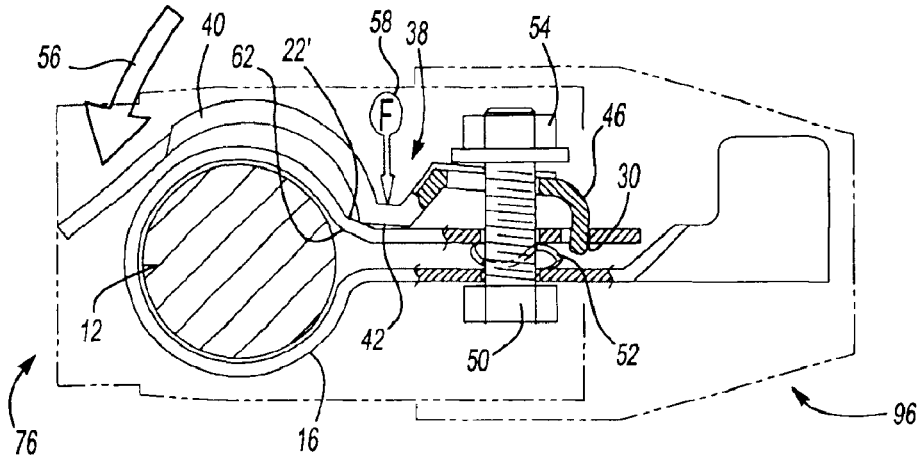
FIG. 10 is an underside view, similar to that previously illustrated in FIG. 3, and showing a modification of the battery terminal and by which a shoulder portion of the looped terminal is angled to facilitate engagement about the battery post.
Figure 11:
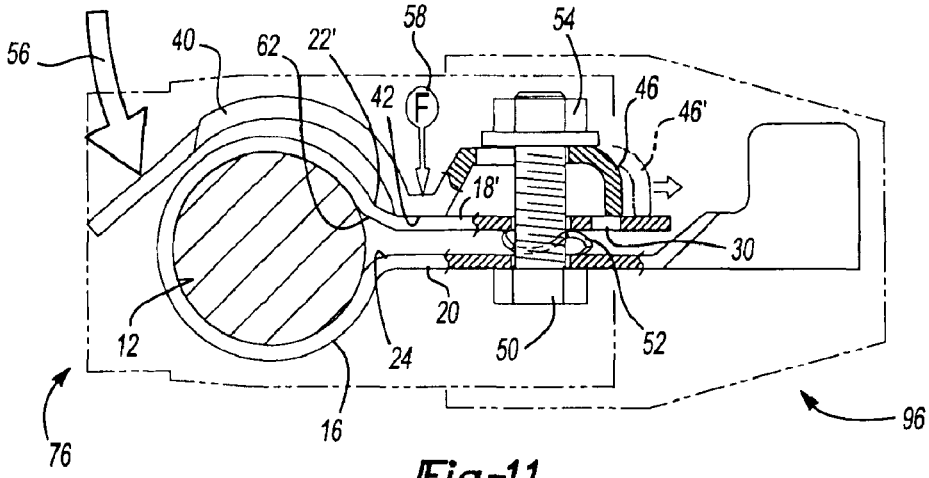
FIG. 11 is a succeeding underside view of the battery terminal illustrated in FIG. 10 and showing the lever arm associated in both engaged and rearwardly displaced positions relative to looped terminal and threaded mounting bolt.

In a further defined variant, and referencing FIGS. 10 and 11, a shoulder 62 is established in a modification 18' of the projection portion and between selected annular shaped end location 22' and associated projecting portion. The shoulder 62 is further configured to resistively engage an edge of the lever arm intermediate portion 42 (see FIG. 10) upon engagement of the lever arm 38 and to thereby provide an additional degree of both clamping engagement of the terminal 14 about the battery post 12 and associated resistive holding force of the lever arm 38 against the terminal. Referring further to FIG. 11, this view corresponding to the condensed illustrations of FIGS. 4 and 5, the lever arm 38 is again rearwardly displaced upon unseating of the tab 46 and as is further referenced by its rearwardly displaced and reseated position 46'.

Figure 12:
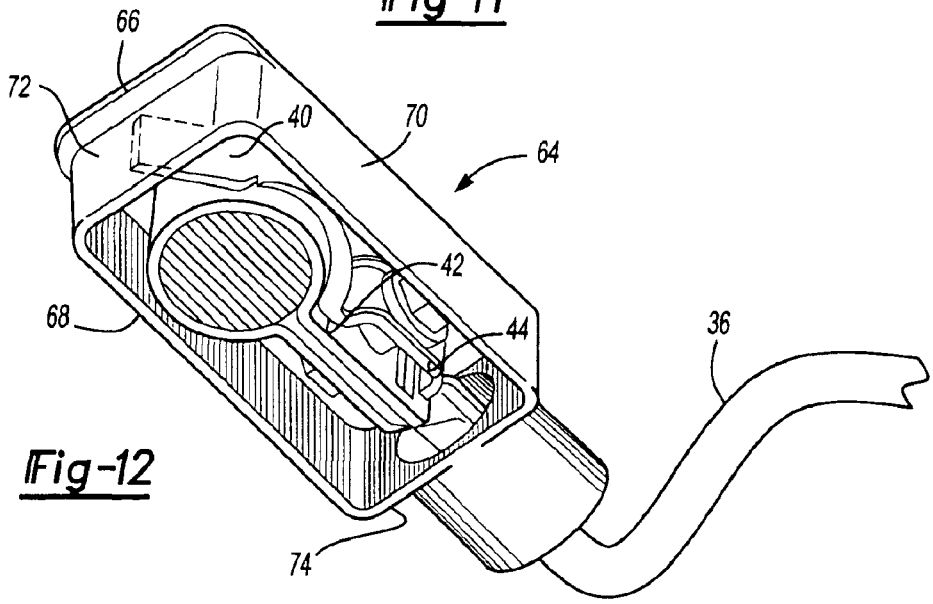
FIG. 12 is an underside perspective view of the battery terminal according to the present invention and illustrating a modified variant of the plastic cover.

Referring to each of FIGS. 1–11 and FIG. 12, two variants of an electrically insulated cover are shown and which are engageable over the battery terminal clamping mechanism and upon first engaging the lever arm 38 against the terminal 14. Referring first to FIG. 12, a one-piece variant 64 is exhibited and, in its preferred application, is constructed of a soft rubberized or PVC material. The cover 64 includes a planar shaped base 66 and four interconnected and downwardly extending side walls 68, 70 and end walls 72 and 74.

Alternatively, and referencing the primary variant of FIGS. 1–11, the cover is designed as a hard plastic two piece construction. As best shown in the exploded view of FIG. 2, a first cover member 76 (typically constructed of a Valox, Cycolac or PBT material) again includes a base surface 78 and incorporates a downwardly extending front wall 80 exhibiting an inwardly extending catch portion 82. Additional side walls 84 and 86 are also exhibited and the first cover member 76 is rotatably secured to opposite projecting ends of the fastener 50 by virtue of mounting locations 88 and 90 (see again FIG. 2). The mounting locations 88 and 90 are each further configured by interiorly facing hex-shaped apertures and which, upon mounting, receive respectively the hex head of the bolt 50 and attachable flange nut 54, respectively to secure the first cover member 76 thereupon. The first cover further includes configured channels formed in the corresponding rearward end, and forwardly of the mounting locations 88 and 90, the channels further being illustrated at 92 and 94 in FIG. 2.

A second cover member is illustrated at 96 (typically further constructed of a hard plastic material such as those previously discussed, as well as also potentially polypropylene) and includes a top surface 98 and side surfaces 100 and 102 terminating in forward and inwardly directed locations by pins 104 and 106 respectively. The pins 104 and 106 seatingly engage within the associated and arcuate channels 92 and 94 and to eccentrically secure the second cover member 96 to the first cover member 76. A forward top portion 108 of the second cover member is secured along a rearward living hinge 110 to facilitate a front edge contact with the rear of the first cover member 78 (see FIG. 6).

Figure 6:
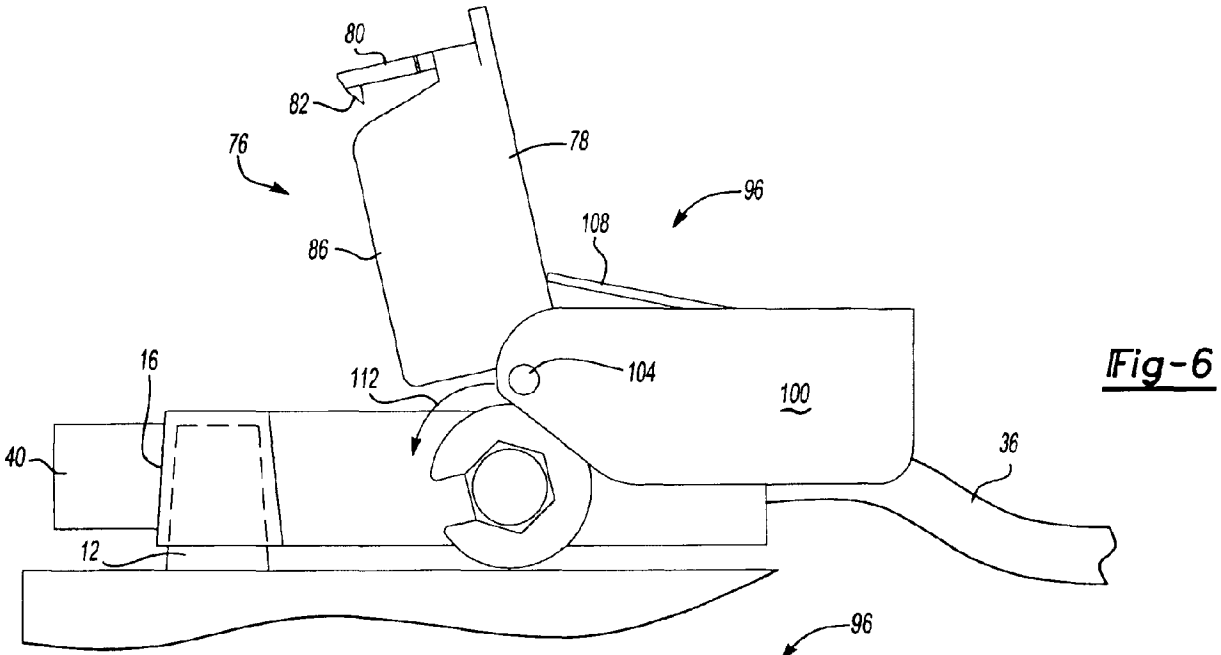
FIG. 6 is a side view of the battery terminal design according to the embodiment of FIG. 1 and illustrating the two-piece plastic cover in a first disengaged position.
Figure 7:
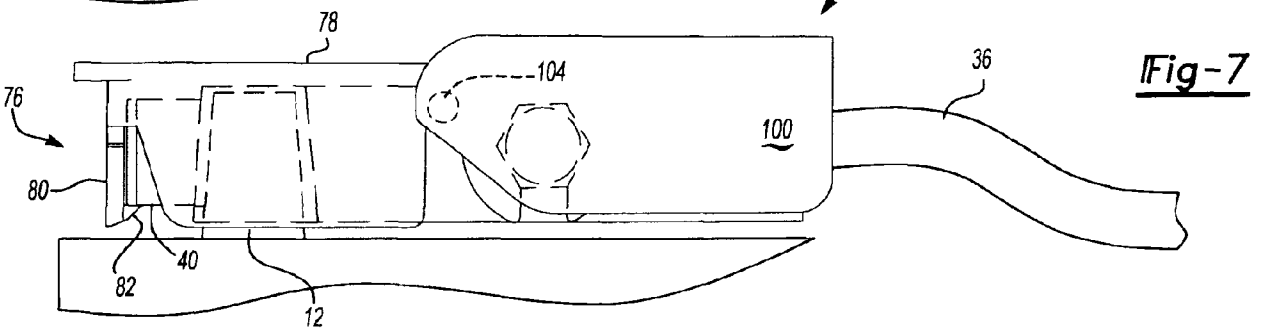
FIG. 7 is a succeeding side view of the battery terminal design and illustrating the plastic cover in a forwardly rotated and engaged position about the battery terminal.

As further is best shown when viewing FIGS. 6 and 7 in succession, the downwardly and forwardly rotating motion of the first covering member 78 results in an eccentric motion (see arrow 112 in FIG. 6). In this fashion, the second cover member 96 provides a rearwardly disposed and restraining bias to the first cover member 78 and associated catch portion 82 in the engaged position; this relationship again resulting from a rearward pulling force imparted to the first covering member 78 responsive to the eccentric cam relationship established between the pins 104 and 106 and associated channels 92 and 94, and combined further with the spring biasing rotation of the bolt 50 by the hex configured mounting locations 88 and 90 of the first covering member 76.

Figure 8:
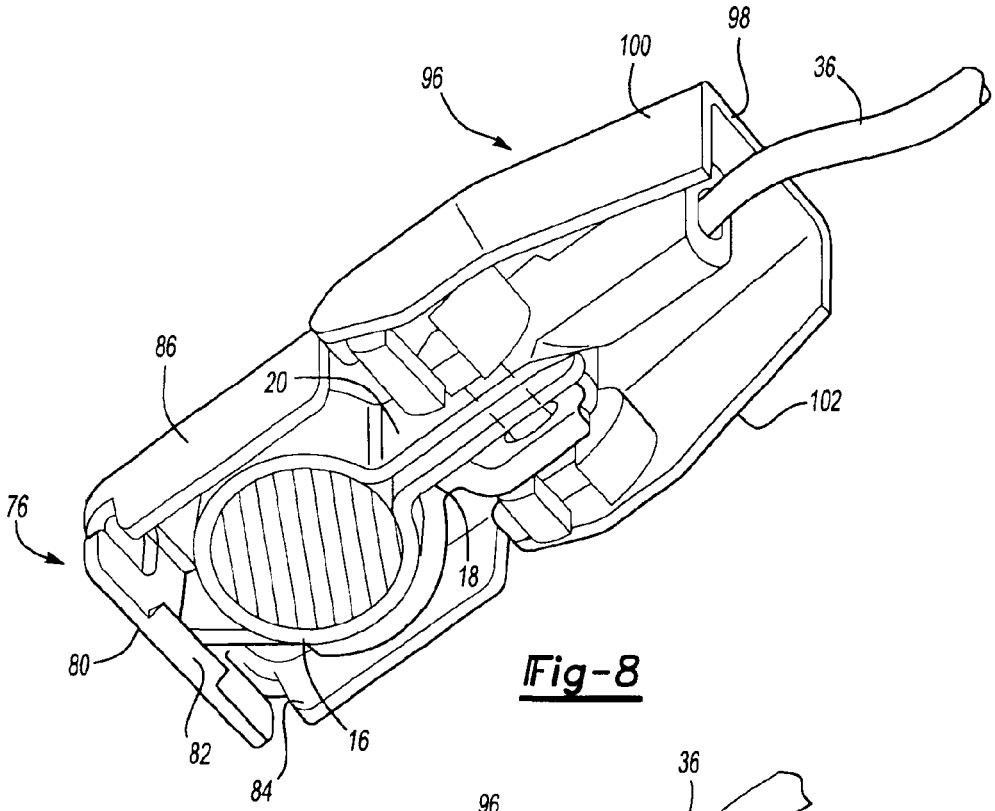
FIG. 8 is an underside perspective view of the battery terminal design according to FIG. 1 and in its fully engaged position of FIG. 7.
Figure 9:
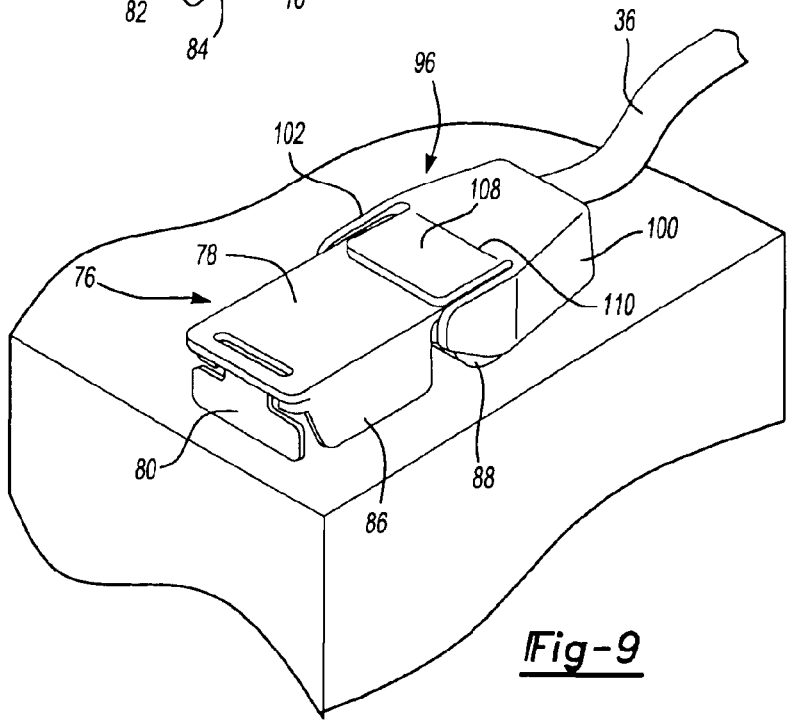
FIG. 9 is an elevational perspective view of the battery terminal illustrated in FIG. 8.

As previously explained, the primary clamping mechanism is first engaged in the position illustrated in FIG. 5, whereupon the two piece cover is pivotally actuated to the configuration shown in FIGS. 7, 8 and 9. In this manner, the inwardly configured catch portion 82 functions as a secondary and restraining/holding force to the engaged clamping mechanism and by virtue of it abutting and holding the forwardly most extending portion of the arcuate shaped portion 40 of the lever arm 38.

Figure 13:
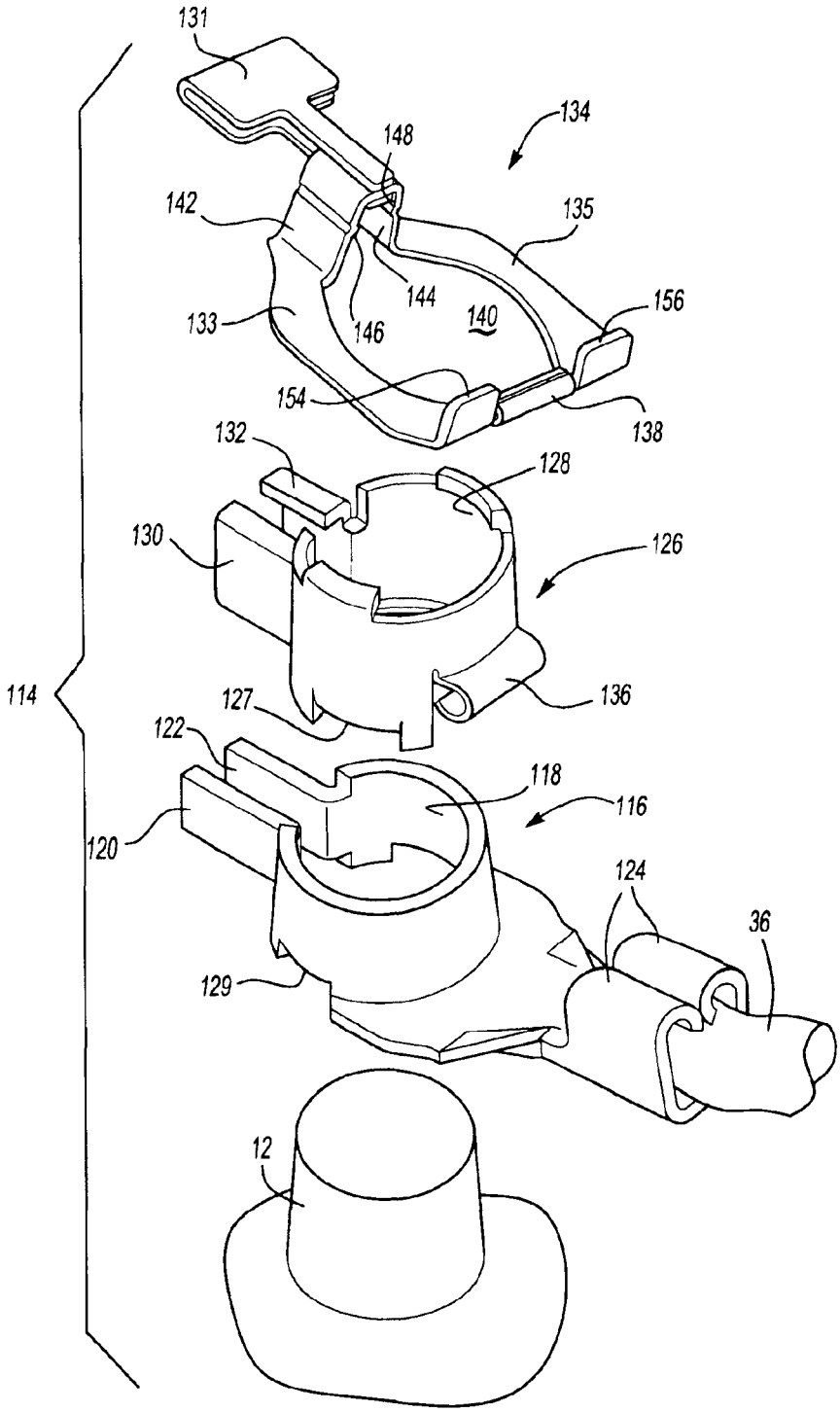
FIG. 13 is an exploded view of the battery terminal according to a further preferred embodiment of the present invention.
Figure 14:
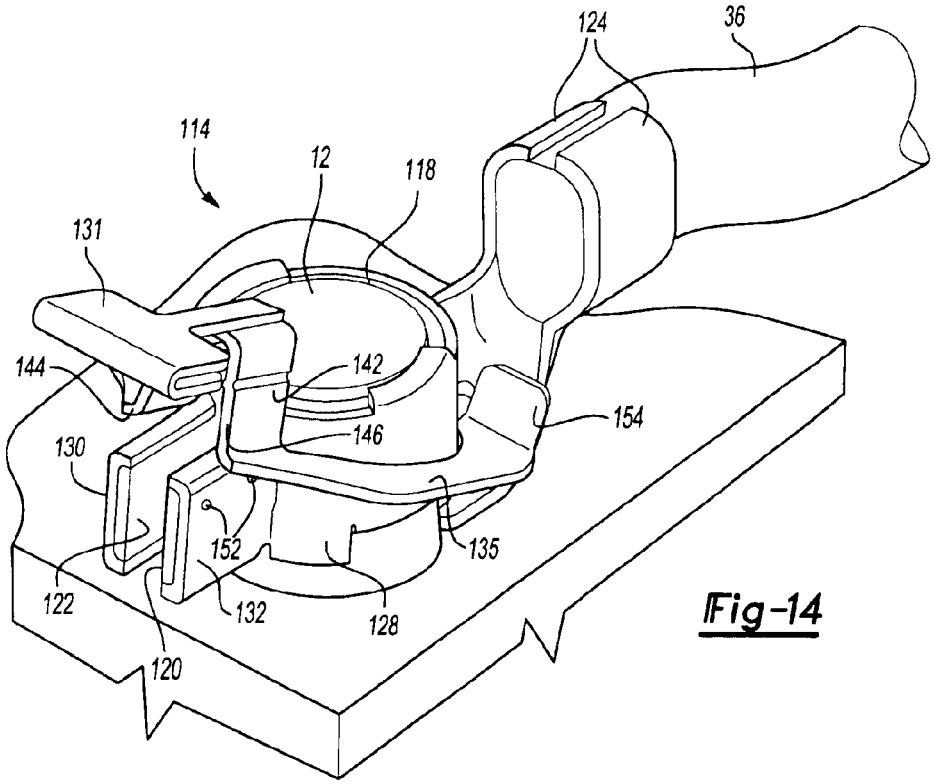
FIG. 14 is an assembled perspective view of the battery terminal of FIG. 13 and in a first substantially disengaged position.

Referring now to FIGS. 13 and 14, a terminal clamping mechanism is illustrated at 114 according to a second preferred embodiment. As with the clamping mechanism according to the first preferred embodiment 10, the mechanism 114 again discloses a compressible battery terminal 116, typically constructed of a stamped 1.5 mm copper sheet post, and exhibiting a substantially annular (and conical/tapered) shaped portion 118 generally corresponding to an exterior configuration of the battery post 12.

The terminal 116 also includes a pair of first and second projecting portions 120 and 122, extending in spaced apart manner from opposing ends of the annular shaped portion 118, however, and in the second embodiment, the spaced apart portions 120 and 122 project forwardly and as opposed to rearwardly of the annular shaped portion as in the previously disclosed embodiment. As with the first preferred embodiment, a rearwardly extending location of the terminal 116 is further exhibited by gripping portions 124 for gripping the exposed end of the cable 36.

An overlaying hinge is illustrated at 126, the hinge exhibiting an annular shaped portion (again tapered/conical) 128 which overlays and engages with the base terminal assembly 116. Bottom tabs 127 interface with recessed bottom edge locations 129 (see both in FIG. 13) and such that the tabs 127 are bent inwardly to secure the hinge 126 over the terminal portion 118. It is also important to point out that, while disclosing the provision of an overlaying hinge 126, it is also envisioned that the clamping mechanism is understood to be capable of operating with the features of the hinge 126 incorporated integrally into the terminal 116. That said, the hinge 126 also includes a pair of spaced apart portions 130 and 132, extending from opposing end locations of the annular shaped portion 128 and which overlay the projecting portions 120 and 122 associated with the terminal 116.

A lever arm 134 (typically constructed of a spring steel) is hingedly engaged to a rearwardly disposed location of the annular shaped portion, and this is in particular provided by a sleeve 136 integrally defined at a rearward location of the hinge 126 and within which is seatingly and pivotally engaged a pin 138 defined by a rearward-most portion of the lever arm 134 (see again as is best shown in FIG. 13). The lever arm 134 further include extending side walls 133 and 135 which exhibit, therebetween, a generally open central portion (140 in FIG. 13) corresponding in dimension to a cross section of the annular shaped portions of the hinge, at 128, the terminal, at 118, and the underlying battery post 12.

The lever arm 134 further includes a forwardly directed and inwardly tapered portion, defined by angled side walls 142 and 144 and which, upon downward actuation of the lever arm 134 and concurrent with placement of the annular shaped portions of the hinge 128 and underlying terminal 118 about the battery post 12, contact and subsequently compress the spaced apart projecting portions 120 and 122 (and overlaying hinge portions 130 and 132) of the terminal 116 in a spring biasing and engaging fashion about the post 12. A handle portion 131 extends forwardly from a top edge location of the tapered portion and facilitates actuation of the lever arm 134.

Additional features of the second preferred embodiment include the tapered portion being resistively engaged to the spaced apart portions 130 and 132. Opposing and inwardly facing surfaces of the tapered portion in this variant exhibit a first pair of projections, see axially extending ridges 146 and 148, and correspond to outwardly and opposite facing surfaces of the hinge portions 130 and 132, upon which are defined a second pair of projections in the form of pairs of dimples 150 and 152.

Figure 15:
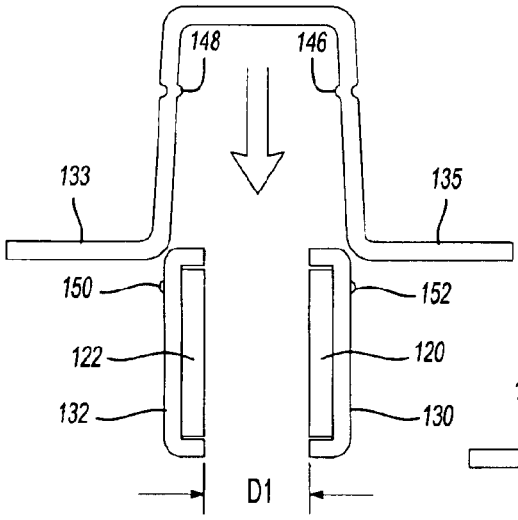
FIG. 15 is a front sectional view of the battery terminal according to FIG. 13 and illustrating the lever arm in the disengaged position substantially shown in FIG. 14 and relative to the forwardly projecting portions of the compressible terminal.
Figure 16:
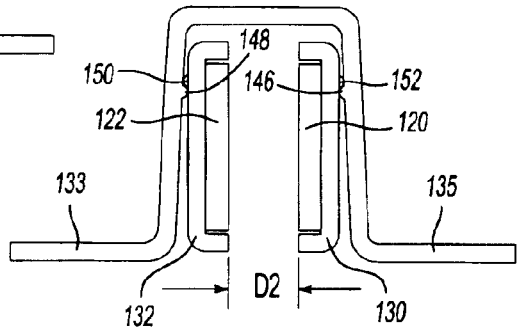
FIG. 16 is a front sectional view of a succeeding and engaged position established between the lever arm and compressible terminal.

As best illustrated in the succeeding views of FIGS. 15 and 16, and upon engagement of the lever arm 134, the first pair of projections (ridges 146 and 148) resistively interengage with the second pair of projections (dimples 150 and 152), with the result that the projecting portions 120 and 122 of the terminal 116 are squeezed inwardly and, correspondingly, grippingly engage the annular/conical portion 118 about the corresponding exteriorly facing surface of the battery post 12.

The handle portion 131 again facilitates the pivoting engagement of the lever arm 134 by providing an effective gripping surface. The lever arm further includes a pair of upwardly extending wing portions 154 and 156, at opposite ends of the pin 138 and in order to provide lateral stability to the hingedly connected lever arm 134.

Having described the presently preferred embodiments, it is to be understood that the invention may be otherwise embodied within the scope of the appended claims.

What is claimed is:

1. A terminal clamping mechanism for use with a conventional battery having an upwardly extending post, said clamping mechanism comprising:

a compressible battery terminal exhibiting a substantially annular shaped portion generally corresponding to an exterior configuration of the battery post, first and second projecting portions extending in spaced apart manner from opposing ends of said annular shaped portion; and a lever arm exhibiting an elongate and arcuate shape, a first end of said lever arm being secured to a fastener extending through apertures in said spaced apart projecting portions, an intermediate portion of said lever arm abutting against a selected projecting portion and, upon inward actuation of a second arcuate shaped end of said lever arm concurrent with placement of said annular shaped portion about the battery post, said lever arm compressing said terminal in a spring biasing and engaging fashion about the post.

2. The terminal clamping mechanism as described in claim 1, said lever arm further comprising an elongated slot extending a projected distance along said first end, said first end terminating in an inwardly directed tab extending through a further aperture defined in said abutting projection portion such that, upon actuation of said lever arm, said tab releasing from said further aperture and said arm being rearwardly displaced to reseat said tab against said projecting portion in said engaged position.

3. The terminal clamping mechanism as described in claim 2, further comprising a shoulder established between a selected annular shaped portion and associated projecting portion, said shoulder being configured to resistively engage said intermediate portion upon engagement of said lever arm.

4. The terminal clamping mechanism as described in claim 1, said fastener further comprising a threaded bolt, a wave washer supported on said threaded bolt and sandwiched between said projecting portions, a nut engaging over a threaded projecting end of said bolt.

5. The terminal clamping mechanism as described in claim 1, further comprising at least one pair of gripping portions extending from an end of said terminal, said gripping portions being configured to grip an exposed end of an electrical cable.

6. The terminal clamping mechanism as described in claim 1, further comprising an electrically insulated cover engageable over said battery terminal in an engaged position.

7. The terminal clamping mechanism as described in claim 6, said cover including a planar shaped base and at least a forward and downwardly projecting catch portion against which is engaged a forwardly most projecting end of said lever arm.

8. The terminal clamping mechanism as described in claim 7, said cover further comprising a two piece assembly including a first cover member incorporating said catch portion and rotatably secured to opposite projecting ends of said fastener and a second cover member eccentrically secured to said first cover member, said second cover member providing a rearwardly disposed and restraining bias to said first cover member and associated catch portion in said engaged position.

9. The terminal clamping mechanism as described in claim 6, said insulated cover exhibiting a specified shape and size and being constructed from a material including at least hard plastic, polypropylene, rubber and PVC.

10. The terminal clamping mechanism as described in claim 1, said annular shaped terminal portion further comprising a substantially three dimensional and conical shape corresponding to that of the battery post.

11. A terminal clamping mechanism for use with a conventional battery having an upwardly extending post, said clamping mechanism comprising:

a compressible battery terminal exhibiting a substantially annular shaped portion generally corresponding to an exterior configuration of the battery post, first and second projecting portions extending in spaced apart manner from opposing ends of said annular shaped portion;

a lever arm hingedly engaged to a rearward disposed location of said annular shaped portion, said lever arm exhibiting a generally open central portion corresponding in dimension to a cross section of said annular shaped portion, said lever arm further comprising a forwardly directed and inwardly tapered portion which, upon downward actuation of said lever arm and concurrent with placement of said annular shaped portion about the battery post, contacts and subsequently compresses said spaced apart projecting portions of said terminal in a spring biasing and engaging fashion about the post; and an overlaying hinge, said hinge exhibiting an annular shaved portion which overlays and engages with said annular shaped portion of said terminal, said hinge further exhibiting a pair of spaced apart portions which overlay said projecting portions associated with said terminal.

12. The terminal clamping mechanism as described in claim 11, further comprising said tapered portion being resistively engaged to said spaced apart portions in an engaged position.

13. The terminal clamping mechanism as described in claim 12, further comprising opposing and inwardly facing surfaces of said tapered portion exhibiting a first pair of projections, corresponding outwardly and opposite facing surfaces of said spaced apart hinge portions exhibiting a second pair of projections which, upon engagement of said lever arm, resistively interengage with said first pair of projections.

14. The terminal clamping mechanism as described in claim 13, said first pair of projections further comprising axially extending ridges, said second pair of projections each further comprising a pair of spaced apart dimples.

15. The terminal clamping mechanism as described in claim 11, further comprising a handle portion projecting from a forward-most location of said lever arm.

16. The terminal clamping mechanism as described in claim 11, further comprising a sleeve integrally defined at said rearward disposed location of said annular shaped portion, a rearward-most location of said lever arm including a pin resistively seated within said sleeve portion.

17. The terminal clamping mechanism as described in claim 11, further comprising at least one pair of gripping portions extending from an end of said terminal, said gripping portions being configured to grip an exposed end of an electrical cable.

18. The terminal clamping mechanism as described in claim 16, said lever arm further comprising a pair of upwardly extending wing portions at opposite ends of said pin and in order to provide lateral stability to said hingedly connected lever arm.

19. The terminal clamping mechanism as described in claim 11, said annular shaped terminal portion further comprising a substantially three dimensional and conical shape corresponding to that of the battery post.

20. The terminal clamping mechanism as described in claim 11, said lever arm having a specified shape and size and being constructed from a first material including at least a spring steel said compressible terminal being constructed from a second material including at least copper.

* * * * *

UNITED STATES PATENT AND TRADEMARK OFFICE

CERTIFICATE OF CORRECTION

PATENT NO. : 6,872,099 B2
DATED : March 29, 2005
INVENTOR(S) : Gavril Cret

It is certified that error appears in the above-identified patent and that said Letters Patent is hereby corrected as shown below:

Column 8,
Line 19, “rearward-most” should read -- rearward most --.

Column 10,
Line 20, “shaved” should read -- shaped --.

Signed and Sealed this

Twelfth Day of July, 2005

JON W. DUDAS
*Director of the United States Patent and Trademark Office*